United States Patent [19]

Armstrong et al.

[11] 4,270,897

[45] Jun. 2, 1981

[54] PHOTOFLASH LAMP CONSTRUCTION AND METHOD OF MAKING SAME

[75] Inventors: Donald E. Armstrong, Williamsport; Ronald E. Sindlinger, Muncy; William J. Harvey, Trout Run, all of Pa.

[73] Assignee: GTE Products Corporation, Stamford, Conn.

[21] Appl. No.: 971,775

[22] Filed: Dec. 21, 1978

[51] Int. Cl.[3] ..... F21K 5/02

[52] U.S. Cl. ..... 431/362; 431/365

[58] Field of Search ..... 431/362, 365, 368

[56] References Cited

U.S. PATENT DOCUMENTS

| | | | |
|---|---|---|---|
| 3,312,085 | 4/1967 | Schilling et al. | 431/362 |
| 3,627,459 | 12/1971 | Tas et al. | 431/362 |
| 3,721,515 | 3/1973 | Boekkooi et al. | 431/362 |
| 3,873,261 | 3/1975 | Cote | 431/362 |
| 4,008,040 | 2/1977 | Murray et al. | 431/362 |

*Primary Examiner*—Joseph Man-Fu Moy
*Attorney, Agent, or Firm*—Edward J. Coleman

[57] ABSTRACT

A high-voltage type photoflash lamp filled with a filamentary combustible material and oxygen and having an ignition structure including a pair of spaced-apart lead-in wires sealed in one end of the glass envelope of the lamp and encapsulated within an interior protruding portion of the envelope glass. The termination of each of the lead-in wires within the envelope is bare of sealing glass and substantially flush with the surrounding glass surface, and a coating of primer material about the inner end of the protruding portion of glass within the envelope covers and bridges the bare terminations of the lead-in wires. Also disclosed is a method of making a lamp including the steps of heating one end of a length of glass tubing to seal it closed, pushing a pair of spaced-apart metal lead-in wires through the heated, closed end of the glass tubing whereby the heated glass thereat is stretched and sealed over the wires to provide a protruding portion of glass within the tubing which encapsulates the termination of the lead-in wires, selectively removing only the glass covering the terminations of the lead-in wires to expose the bare metal thereof, applying a coating of primer material about the end of the protruding portion of glass within the tubing so as to cover and bridge the bare terminations of the lead-in wires, and then finishing the lamp.

5 Claims, 8 Drawing Figures

PHOTOFLASH LAMP CONSTRUCTION AND METHOD OF MAKING SAME

BACKGROUND OF THE INVENTION

This invention relates to photoflash lamps and, more particularly, to flashlamps of the type containing a primer bridge, or the like, ignited by a high-voltage pulse.

Such flashlamps typically comprise a tubular glass envelope constricted and tipped off at one end and closed at the other end by a press seal. A pair of lead-in wires pass through the glass press and terminate in an ignition structure including a glass bead, one or more glass sleeves, or a glass reservoir of some type. A mass of primer material contained on the bead, sleeve or reservoir bridges across and contacts the ends of the lead-in wires. Also disposed within the lamp envelope is a quantity of filamentary metallic combustible, such as shredded zirconium or hafnium foil, and a combustion-supporting gas, such as oxygen, at an initial fill pressure of several atmospheres.

Lamp functioning is initiated by application of a high-voltage pulse (e.g. several hundred to several thousand volts as, for example, from a piezoelectric crystal), across the lamp lead-in wires. The mass of primer within the lamp then breaks down electrically and ignites; its deflagration, in turn, ignites the shredded combustible which burns actinically.

Several different constructions for high-voltage flashlamps have been described in the prior art. The following U.S. Pat. Nos. are examples: U.S. Pat. Nos. 2,718,771; 2,768,517; 2,771,765; 2,868,003; 3,000,200; 3,312,085; 3,501,254; 3,556,699; 3,602,619; 3,627,459; 3,685,947; 3,721,515; 3,823,994; 3,873,260; 3,873,261; 3,884,615; 3,959,860; 4,008,040; 4,059,388; 4,059,389; and 4,097,220. All of these constructions have either been difficult to fabricate, contained extra and costly glass components, or suffered from shred-caused pre-flash short circuits. Some of the referenced constructions are not adaptable to miniaturization and use in multilamp flash devices of modern design. Many require the use of intricate, tiny glass parts that are very expensive, difficult to feed, and to orient and slip over the lead-in wires in automated, high-speed lamp-making machinery. Reliable automated primer application would not be feasible with some of the designs. Other designs would so vary in firing voltage from one lamp to another that reliable operation could not be obtained with the voltage and energy levels available from miniaturized piezoelectric sources that would fit in the present small cameras. Some of the constructions fail to recognize the problem of shred shorting or shred interference with ignition.

In contrast to the above-mentioned prior art lamp constructions, U.S. Pat. No. 4,059,389 describes a beadless ignition structure with frit-coated inner leads. Although this structure represents a significant improvement in flash reliability and manufacturing simplicity over the prior art, there are problem areas that may arise. For example, if the primer is bridged from lead to lead, expansion differentials from heating to cooling during manufacture sometimes cause the primer bridge to crack open sufficiently so that the high voltage pulse will not jump the gap to flash the lamp. If the lamp is made with separate primer-coated leads, it is necessary that the combustible shreds within the lamp contact both primer-coated lead ends to complete the circuit path. In actual practice, the combustible distribution may occasionally be wadded and located such that it does not make good contact with the primer-coated lead ends and, thus, result in a lamp that fails to flash.

SUMMARY OF THE INVENTION

In view of the foregoing, it is an object of this invention to provide an improved photoflash lamp construction.

A particular object of the invention is to provide an improved construction for miniature high-voltage type, photoflash lamp which is readily adapted to automated assembly, eliminates the need for expensive lamp components, such as glass beads or sleeves, and eliminates the problem of shred-caused short circuits prior to flashing.

A principle object is to provide a bridged primer between the igniter lead-in wires that will not crack apart and is not dependent upon combustible contact to complete the circuit path.

It is a further object of the invention to provide a strong insulated ignition mount which is comparatively simple to manufacture and provides a more positive open circuit after lamp flashing.

Still another object of the invention is to provide an improved method of making a photoflash lamp.

These and other objects, advantages, and features are attained, in accordance with the principals of this invention by providing a high-voltage lamp ignition structure comprising a pair of spaced-apart metal lead-in wires sealed in one end of the glass envelope of the lamp, with the glass-sealed wires extending inside the envelope and the metal termination of each wire within the envelope being bare of the sealing glass. The metal surface of each of the bare wire terminations is substantially flush with the surrounding sealing glass surface, and primer material is coated about the inner end of the glass-sealed extension of the wires in a manner covering and bridging the bare metal terminations. In a preferred embodiment, the envelope glass protrudes inside the envelope and the lead-in wires are sealed within this protruding glass portion in a predetermined, spaced-apart relationship, the protruding glass having a stretched configuration from the lead-in wires having been pushed through the end of the envelope during heat sealing. Preferably, each of the lead-in wire terminations has the configuration of a transverse cut having a substantially flat end surface, with each of the flat end surfaces being bare of glass and substantially flush with the surrounding glass surface. The primer material is then coated about the inner end of the protruding portion of glass within the envelope so as to cover and bridge the terminations.

This construction provides a supported circuit path from lead to lead which will not crack apart due to the solid glass coating covering and supporting both internal leads, and is also independent of combustible contact to complete the flashing circuit. Further, ignition breakdown voltage is higher, more uniform, and can be controlled by varying the spacing between the inner leads. Average breakdown voltages of 600 to 1200 volts can be maintained, and this decreases susceptibility to inadvertent ignitions during lamp manufacture and subsequent handling. Use of the envelope body tubing as the glass coating for the ignition wires provides a strong support structure for this mount which also fully insulates each of the internal lead-in wires against pre-flashed shorting due to the placement of the combustible shreds within the lamp. In making the structure, the internal glass forming results in well-rounded contours that add additional strength to the vessel. Further, the fully insulating glass coating on the leads, with only necessary exposure of bare metal lead-wire terminations for ignition, provides a unique means to assure an open circuit after flashing.

The method of making the lamps is particularly well adapted to high-volume manufacture and includes the steps of heating one end of the length of glass tubing to seal it closed, pushing a pair of spaced-apart metal lead-in wires through the heated closed end of the glass tubing whereby the heated glass is stretched and sealed over the pushed-through lead-in wires to provide a protruding portion of glass within the tubing which encapsulates the terminations of the lead-in wires therein, selectively removing only the glass covering the terminations of the lead-in wires within the tubing to expose the bare metal of said terminations, applying a coating of primer material about the end of the protruding portion of glass within the tubing so as to cover and bridge the bare metal termination, and finishing the lamp. According to a preferred embodiment, the coating of primer material is applied by dipping the end of the protruding portion of glass within the envelope into a primer cup. After pushing through the lead-in wires, the heated closed end of the tubing may be pinch pressed. Also, the protruding portion of the glass within the tubing may be finish-shaped with internal air pressure. A particularly preferred method of selectively removing the glass covering the lead-wire terminations comprises making electrical contact to the outer portions of the lead-in wires, independently applying a high-voltage potential to each contacted lead-in wire, and inserting a conductive probe into the tubing in close proximity to each of the glass-covered terminations, whereby the resulting high-voltage discharge between each lead-in wire termination and the probe cracks off only the glass covering the terminations to expose the bare metal thereof.

BRIEF DESCRIPTION OF THE DRAWINGS

This invention will be more fully described hereinafter in conjunction with the accompanying drawings, in which.

DESCRIPTION OF PREFERRED EMBODIMENT

Figure 1:
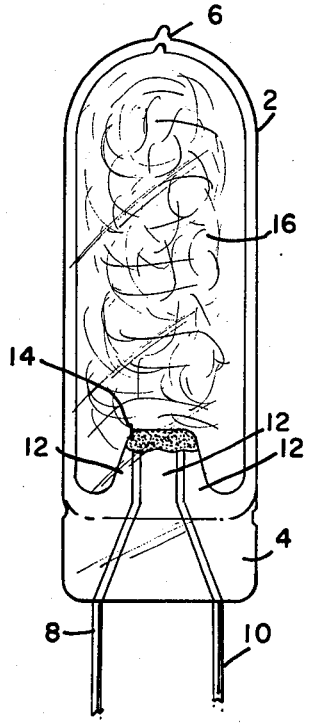
FIG. 1 is an elevational view of a photoflash lamp made in accordance with the invention.
Figure 2:
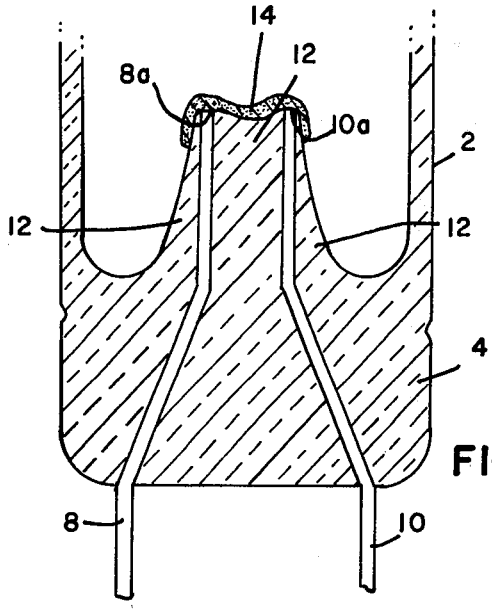
FIG. 2 is a fragmentary vertical sectional view on an enlarged scale of the inlead and ignition means construction of the lamp of FIG. 1.

Referring to FIGS. 1 and 2, the high-voltage type flashlamp illustrated therein comprises an hermetically sealed light-transmitting envelope 2 of glass tubing having a pinch-press seal 4 defining one end thereof and an exhaust tip 6 defining the other end thereof. Supported by the seal 4 is an ignition means including a pair of metal lead-in wires 8 and 10 extending into the envelope 2. In accordance with the invention, a portion 12 of the envelope glass at the seal 4 end thereof protrudes inside the envelope, and the lead-in wires 8 and 10 are sealed within the protruding portion 12 in a predetermined spaced-apart relationship with the respective terminations 8*a* and 10*a* of the wires 8 and 10 being bare of the sealing glass. Preferably, each of the wire terminations 8*a* and 10*a* has the configuration of a transverse cut having a substantially flat end surface. In addition to being bare of sealing glass, these flat end surfaces 8*a* and 10*a* are substantially flush with the surrounding glass surface of portion 12.

The ignition structure is completed by a coating of primer material 14 about the inner end of the glass protruding portion 12. More specifically, the primer coating 14 covers and bridges the bare metal terminations 8*a* and 10*a* of lead-in wire 8 and 10.

Typically, the lamp envelope 2 has a internal diameter of less than one-half inch and an internal volume of less than one cubic centimeter. A quantity of filamentary combustible fill material 16, such as shredded zirconium or hafnium foil, is disposed within the lamp envelope. The envelope 2 is also provided with a filling of combustion-supporting gas, such as oxygen, at a pressure of several atmospheres. Typically, the exterior surface of the glass envelope 2 is also provided with a protective coating, such as cellulose acetate (not shown).

Figure 3:
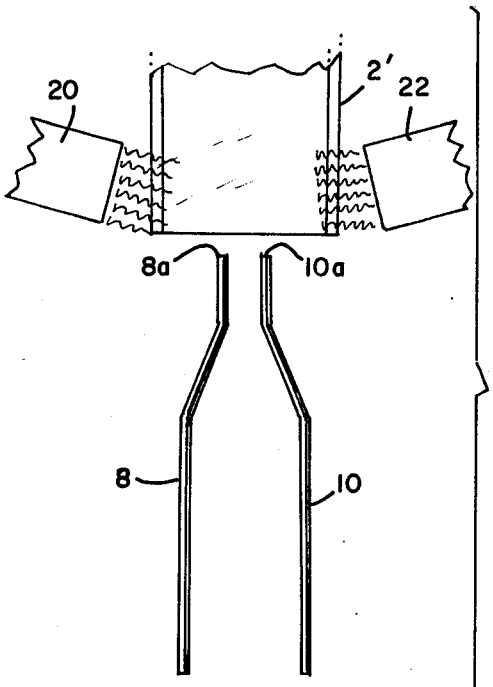
FIG. 3 illustrates the method step of applying heat to one end of a length of glass tubing held over a pair of lead-in wires.
Figure 4:
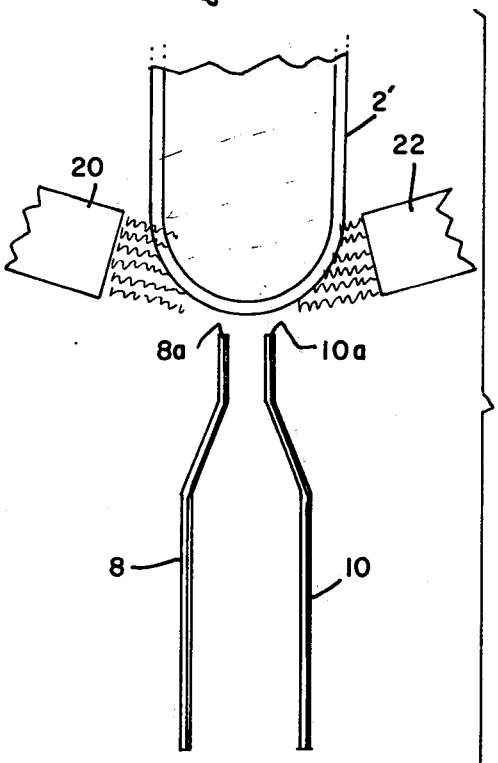
FIG. 4 illustrates the heated end of tubing of FIG. 3 being sealed closed.
Figure 5:
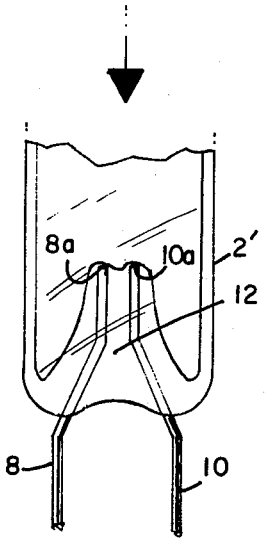
FIG. 5 illustrates the step of pushing lead-in wires through the heated, closed ends of the glass tubing.
Figure 6:
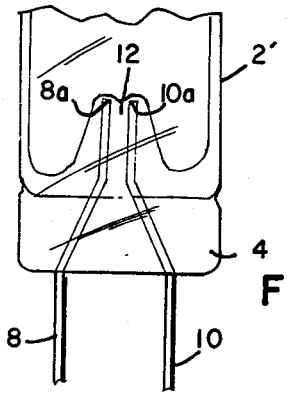
FIG. 6 illustrated the lead-mount end of the glass tubing after pinch-pressing.

A preferred method of making a photoflash lamp according to the invention comprises the following steps. First, as shown in FIG. 3, a length of cut glass tubing 2′ is heated at the bottom end by flames from sources 20 and 22. At this time, as illustrated, the tubing 2′ may be held over and in alignment with the preformed lead-in wires 8 and 10, which also may be preheated. This heating process is continued until the heated end of the tubing is sealed closed, as shown in FIG. 4. When the bottom of the glass tubing is properly heated and sealed closed, the tubing 2′ is then pushed vertically down over the preheated lead-in wires 8 and 10, as shown in FIG. 5, whereby the heated glass is stretched and sealed over the pushed-through lead-in wires 8 and 10 to provide the protruding glass portion 12 which encapsulates the lead-in wire terminations 8*a* and 10*a* within the tubing 2′. The heated, protruding glass portion 12 is then finish-shaped with internal air pressure, and the heated seal may be pinch-pressed at area 4, as shown in FIG. 6. The glass portion 12 completely encapsulates the lead-in wire mount structure, being thinnest at the upper ends of the leads, i.e., at the terminations 8*a* and 10*a*. Various shapes of lead-in wire terminations, such as flat, spherical, pointed and wedge, were tested, and a standard, flat, transverse cut has been found to be satisfactory. As can be seen in FIGS. 3–6, the physical construction is quite simple and is readily adaptable to high-speed manufacturing equipment. In making the one-piece structure, the internal glass forming results in well-rounded contours that add additional strength to the vessel.

Figure 7:
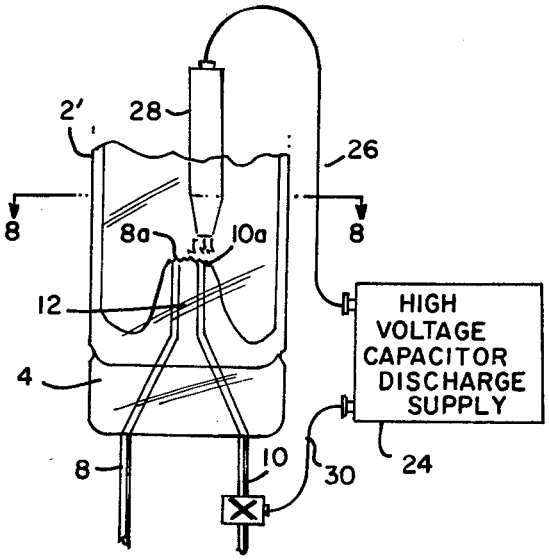
FIG. 7 illustrates the step of selectively removing the glass covering the lead-in wire terminations by means of a high voltage discharge.
Figure 8:
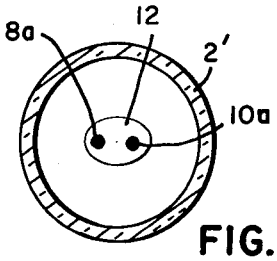
FIG. 8 is a sectional view on line 8—8 of FIG. 7 showing the bare terminations of the lead-in wires after the step of selective glass removal.

In the next phase of the production operation, the glass-covered terminations of the lead-in wires must be bared so that a circuit path can be provided through a bridged primer coating from lead to lead. It is desired that the glass covering over the terminations be very selectively removed so as to only expose the bare metal of the terminations 8*a* and 10*a*. In particular, upon selectively removing the covering glass, the flat end surfaces of the lead-in wire terminations should be substantially flush with the surrounding glass surface. Various concepts of baring the metal ends of the lead-in wires have been explored. These include grinding, chipping, wiping while hot, high voltage RF, high current low voltage, and a capacitor-discharge, low resistance, high voltage circuit in the range of 2,000–20,000 volts. The preferred method uses a capacitor discharge voltage of about 3,000–6,000 volts. The high voltages set-up is illustrated in FIG. 7, with a high voltage capacitor-discharge supply 24 having an output line 26 connected to a probe 28 and an output line 30 connected to a contact means 32, such as an alligator clip, shown here connected to lead-in wire 10. With the glass assembly held in position, electrical contact is made to each of the outer portions of the lead-in wires, while the conductive metal probe 28 is inserted into the top end of the glass tubing 2' in close proximity to each of the glass-covered wire terminations 8*a* and 10*a*, and the high voltage potential is applied independently to each lead-in wire. The resulting high voltage discharge between each lead-in wire termination and the probe cracks off only the glass covering the terminations 8*a* and 10*a* to expose the bare metal thereof, as shown in FIGS. 7 and 8.

After the above glass removal step, the end of the protruding glass portion 12 is dipped into a primer cup, which passes through the open end of the glass tubing, so as to apply the coating 14 of primer material about the end of glass portion 12. As shown in FIGS. 1 and 2, the primer material covers and bridges the bare terminations 8*a* and 10*a* by coating the web of glass between the upper portions of the lead-in wires. This provides a supported circuit path from lead to lead which will not crack apart in view of the solid glass coating (portion 12) covering and supporting both internal leads. Further, this supported primer bridge provides a circuit path which is independent of combustible shred contact to complete the flashing circuit. Ignition breakdown voltage is higher, more uniform and can be controlled by selective predetermination of the spacing between the lead-in wire terminations 8*a* and 10*a*.

After the primer application step, the envelope tubing 2' is filled with a quantity of filamentary combustible material 16, such as shredded zirconium or hafnium, and a combustion-supporting gas such as oxygen. The open end of the tubing is then constricted and tipped off at 6 to provide an hermetically sealed envelope 2. A protective lacquer coating is then applied to the exterior of the glass envelope, such as by dipping and drying. Alternatively, a UV curable photopolymer may be applied as the protective coating as described in copending applications Ser. No. 753,255 filed Dec. 22, 1976 and Ser. No. 20,034 filed Apr. 14, 1978, both assigned to the present assignee.

Operation of such high voltge flashlamps is initiated when a high voltage pulse from, e.g., a piezoelectric crystal, is applied across the two lead-in wires 8 and 10. A spark discharge occurs through the primer bridge 14, and electrical breakdown of the primer causes its deflagration which, in turn, ignites the shredded metallic combustible 16. The fully insulating glass coating on the leads, with only necessary exposure of bare metal for ignition, provides a unique, reliable means for providing an open circuit after flashing.

In one specific embodiment of the invention, a high voltage flashlamp of the type shown in FIG. 1 was provided with an envelope 2 formed from 0.3 inch O.D. tubing of Corning G-1 type soft glass having a coefficient of thermal expansion within the range of 85 to $95\times10^{-7}$ in./in./°C. between 20° C. and 300° C. The internal volume was 0.4 cm.$^3$; the quantity of combustible material was 12.5 mgs. of four-inch long zirconium shreds having a cross section of 0.0008 inch$\times$0.0018 inch; the oxygen fill pressure was 725 cm. Hg absolute. The lead-in wires 8 and 10 were 0.014 inch in diameter and formed of Dumet wire to provide the desired glass-to-metal expansion match. Alternatively, the above lamps have also been made using lead-in wires formed of a nickel-iron alloy referred to as 52 alloy which has a mean coefficient of thermal expansion of about $101.0\times10^{-7}$ in./in./°C. between 25° C. and 300° C. The terminations of the wires were provided by a standard transverse cut to provide flat end surfaces. The described high voltage capacitor discharge method was employed for removing the seal glass from wire terminations 8*a* and 10*a*, and approximately 2 mgs. of primer 14 was used for each lamp. The end of protruding glass portion 12 was dip-coated with the primer to provide an average thickness of 2 to 3 mils and the coverage illustrated in FIGS. 1 and 2. One suitable primer composition comprises about 99.0 percent by weight of zirconium powder and 1.0 percent by weight of cellulose nitrite on a dried basis. A protective coating of cellulose acetate lacquer was provided on the exterior of the envelope. Average breakdown voltage of 600–1200 volts were maintained by this lamp structure, and the lamps reliably provided an open circuit after flashing. The predetermined spacing between the lead-in wire terminations was about 0.050 inch.

Although the invention has been described with respect to a specific embodiment, it will be appreciated that modifications and changes may be made by those skilled in the art without departing from the true spirit and scope of the invention. For example, whereas the method of pushing the lead-in wires through the glass tubing has been described as being accomplished by holding the wires stationary and pushing the heated end of the tubing onto the wires, the pushed-through lead configuration may also by provided by holding the tubing stationary and pushing the spaced pair of lead-in wires through the heated, closed end of the stationary glass tubing.

What we claim is:

1. A photoflash lamp comprising:

an hermetically sealed, light-transmitting glass envelope;

a quantity of filamentary combustible material, located within said envelope;

a combustion-supporting gas in said envelope; and ignition means disposed in said envelope in operative relationship with respect to said filamentary combustible material, said ignition means including a pair of spaced-apart metal lead-in wires sealed in one end of said glass envelope, said glass-sealed pair of lead-in wires extending inside said envelope with the metal termination of each of said lead-in wires within said envelope being bare of said sealing glass, said termination of each of said lead-in wires within the envelope having the configuration of a transverse cut with a substantially flat end surface, each of said flat end surfaces of the metal lead-in wire terminations being bare of glass and flush with the surrounding glass surface, and primer material coated about the inner end of the glass-sealed extension of said lead-in wires in a manner covering and bridging said bare metal terminations.

2. The lamp of claim 1 wherein said ignition means comprises a portion of the glass of said envelope at said end thereof protruding inside the envelope, said pair of lead-in wires being sealed within said glass protruding portion in a predetermined spaced-apart relationship.

3. The lamp of claim 2 wherein said protruding portion of glass within said envelope has a stretched configuration as a result of said lead-in wires having been pushed through said end of the envelope during heat sealing thereof.

4. The lamp of claim 1 wherein said end of the glass envelope has a pinch-press seal.

5. The lamp of claim 2 wherein said primer material is coated about the inner end of protruding portion of glass within said envelope.

* * * * *